US006719620B1

(12) United States Patent
Panfili et al.

(10) Patent No.: US 6,719,620 B1
(45) Date of Patent: Apr. 13, 2004

(54) SANDING TOOL

(75) Inventors: Louis Panfili, Berthierville (CA); François Panfili, Berthierville (CA); Jean-Pierre Panfili, Berthierville (CA)

(73) Assignee: A. Richard, S.E.N.C., Montreal (CA)

( * ) Notice: Subject to any disclaimer, the term of this patent is extended or adjusted under 35 U.S.C. 154(b) by 0 days.

(21) Appl. No.: 10/286,166

(22) Filed: Nov. 1, 2002

(51) Int. Cl.[7] ..... B24B 15/02

(52) U.S. Cl. ..... 451/557; 451/515; 451/525; 451/552

(58) Field of Search ..... 451/552, 557, 451/356, 365, 515, 525; 209/135

(56) References Cited

FOREIGN PATENT DOCUMENTS

EP 1 247 617 A1 10/2002

*Primary Examiner*—George Nguyen

(74) *Attorney, Agent, or Firm*—Collard & Roe, P.C.

(57) ABSTRACT

A sanding tool having a plate with opposite sanding and supporting sides, a handle mounted onto the supporting side of the plate, and at least one fastening device operatively connected to the supporting side of the plate for fastening a sandpaper onto the sanding tool in such a manner that most of the sandpaper rests against the sanding side of the plate. Each fastening device has a clamping device and a guiding device. The clamping device is movable with respect to the supporting side of the plate between a first position where the clamping device is away from the supporting side and a second position where the clamping device rests operatively against the supporting side. The guiding device is used for guiding movement of the clamping device along a predetermined path between the first and second positions. In operation, a portion of the sandpaper is removably clamped between the supporting side of the plate and the clamping device when the latter is in the second position. The improved fastening device enables a sandpaper to be mounted onto the sanding tool in a quicker, easier, and simpler manner.

13 Claims, 11 Drawing Sheets

SANDING TOOL

FIELD OF THE INVENTION

The present invention relates to a sanding tool. More particularly, the present invention relates to a sanding tool comprising a plate with opposite sanding and supporting sides, a handle mounted onto the supporting side of the plate, and at least one fastening device operatively connected to the supporting side of the plate for fastening a sandpaper onto the sanding tool in such a manner that most of the sandpaper rests against the sanding side of the plate.

BACKGROUND OF THE INVENTION

Sanding tools and the like are very well known in the art. A typical sanding tool usually comprises a handle for manual operation of the tool and a working surface onto which a sandpaper is mounted and rested so as to be able to carry out sanding applications by passing the sandpaper-covered working surface over the area to be sanded.

Also known in the art are the fastening devices which are commonly used to removably mount a sandpaper onto such a sanding tool. Indeed, a typical fastening device generally consists of a pin projecting from a rear portion of the sanding tool onto which a clamping plate is pivotally mounted. A portion of the sandpaper is generally clamped between the rear portion and the clamping plate and this is generally achieved by urging the plate against the rear portion of the sanding tool by means of a nut threadedly engageable onto the pin and rotated thereabout so as to bias the clamping plate against the rear portion. The nut is usually provided with a pair of projections which are commonly known as "rabbit ears" and which are used to facilitate the rotation of the nut about the threaded pin with the fingers of an operator of the tool.

A major problem associated with the above-mentioned type of fastening device is that several turns of the nut about the pin are generally required to provide the necessary clearance to replace a worn-out sandpaper by a new sandpaper, and this is known to be very time-consuming and very strenuous on one's hands, particularly the fingers. Furthermore, usually two hands are required to carry out such an operation, causing an operator to cease any intermediate activities and having to direct his or her attention onto the sandpaper replacement operation. Another problem associated with the above-mentioned type of sanding tool is that if it is inadvertently flipped-over, when sanding, against the area being worked on, which is often drywall or plaster thereon, then the projections of the "rabbit ears" of the nuts of the fastening devices of the sanding tool will often cause substantial markings onto the area being worked on, which is very disadvantageous for obvious reasons. Indeed, such damages are very often tedious and time-consuming to repair and such damages also prevent an optimal finish from being obtained.

It is also known in the art that workers employing sanding tools usually work for very long periods of time and often require to manually grip and manipulate their sanding tools in very different manners. However, most of the sanding tools in the art are of unwieldy nature because of their shape and size, having often rough and abrupt edges, which make handling of the sanding tools cumbersome and/or strenuous on workers'hands. Therefore, it would be very useful to provide a sanding tool with an ergonomic handle enabling a more comfortable and easier hand gripping.

Hence, in light of the aforementioned, there is a need for a sanding tool comprising an improved fastening device which would enable a sanding paper to be mounted onto the sanding tool in a quicker, easier, and simpler manner than what is possible with the sanding tools available in the prior art. Furthermore, there is also a need for a sanding tool comprising fastening devices deprived of projections so as to prevent a sanding tool being inadvertently flipped-over against a surface being worked on from substantially damaging the same. Furthermore, there is also a need for an improved sanding tool which would have a more ergonomic handle for facilitating the manipulating thereof.

SUMMARY OF THE INVENTION

The object of the present invention is to provide a sanding tool which satisfies some of the above-mentioned needs and which is thus an improvement over the sanding tools known in the prior art.

In accordance with the present invention, the above object is achieved by a sanding tool comprising a plate with opposite sanding and supporting sides, a handle mounted onto the supporting side of the plate, and at least one fastening device operatively connected to the supporting side of the plate for fastening a sandpaper onto the sanding tool in such a manner that most of the sandpaper rests against the sanding side of the plate, said at least one fastening device comprising:

- clamping means movable with respect to the supporting side of the plate between a first position where the clamping means are away from the supporting side and a second position where the clamping means rest operatively against the supporting side; and
- guiding means for guiding movement of the clamping means along a predetermined path between the first and second positions;
- wherein a portion of the sandpaper is removably clamped between the supporting side of the plate and the clamping means when the latter are in the second position.

Preferably, the handle comprises at least one flange extending substantially parallel to the supporting side of the plate at a predetermined distance therefrom; the guiding means comprise a pin extending perpendicularly to the flange and supporting side of the plate, said pin having first and second ends mounted respectively onto the supporting side of the plate and the at least one flange of the handle; and the clamping means comprise a cam and securing means, the cam being rotatably mounted about the pin and movable between the supporting side of the plate and the flange of the handle, and the securing means being used for operatively securing the cam against the supporting side, whereby said portion of the sandpaper is removably clampable between the cam and the supporting side of the plate by rotating the cam and securing the same against the supporting side with the securing means.

Preferably also, the fastening device further comprises a clamping plate mounted about the pin between the cam and the supporting side, and whereby said portion of the sandpaper is removably clampable between the clamping plate and the supporting side by rotating the cam and securing the same against the clamping plate with the securing means.

Preferably also, the fastening device further comprises biasing means for urging the clamping plate away from the supporting side.

Preferably also, the biasing means comprise a spring coaxially mounted about the pin between the clamping plate and the supporting side.

Preferably also, the securing means comprise a protrusion projecting from the cam, and at least one stopper provided on the clamping plate, said at least one stopper being positioned and sized to cooperate with the protrusion of the cam.

Preferably also, the handle of the sanding tool is an ergonomic handle provided with an elastomer covering so as to facilitate handling of the tool.

Preferably also, the device includes two of said fastening devices mounted on opposite sides of the handle.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

In the following description, the same numerical references refer to similar elements. The embodiments shown in the accompanying drawings are preferred.

Moreover, although the present invention was primarily designed for a sanding tool, it may be used with other types of articles and for other purposes, as apparent to a person skilled in the art. For this reason, the expressions "tool", "sanding", "sanding paper" and/or "sandpaper" should not be taken as to limit the scope of the present invention and include all other kinds of items and purposes with which the present invention may be used and could be useful.

Moreover, in the context of the present invention, the expressions "sanding" and "working" may be used interchangeably. Furthermore, expressions such as "area" and "surface", as well as any other equivalent expressions and/or compound words thereof, may be used interchangeably in the context of the present description. The same applies for any other mutual equivalent expressions, such as "device" and "tool" for example, or "sanding paper" and "sandpaper", as well as "fastener" and "fastening device", as apparent to a person skilled in the art.

In addition, although the preferred embodiment of the present invention as illustrated in the accompanying drawings comprises various components such as a cam, a clamping plate, a handle, a flange, a pin, a cam, a spring, etc., and although the preferred embodiment of the sanding tool 1 and corresponding parts of the present invention as shown consist of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the sanding tool 1 and its components according to the present invention, as will be briefly explained herein and as can be easily inferred therefrom, without departing from the scope of the present invention.

Figure 1:
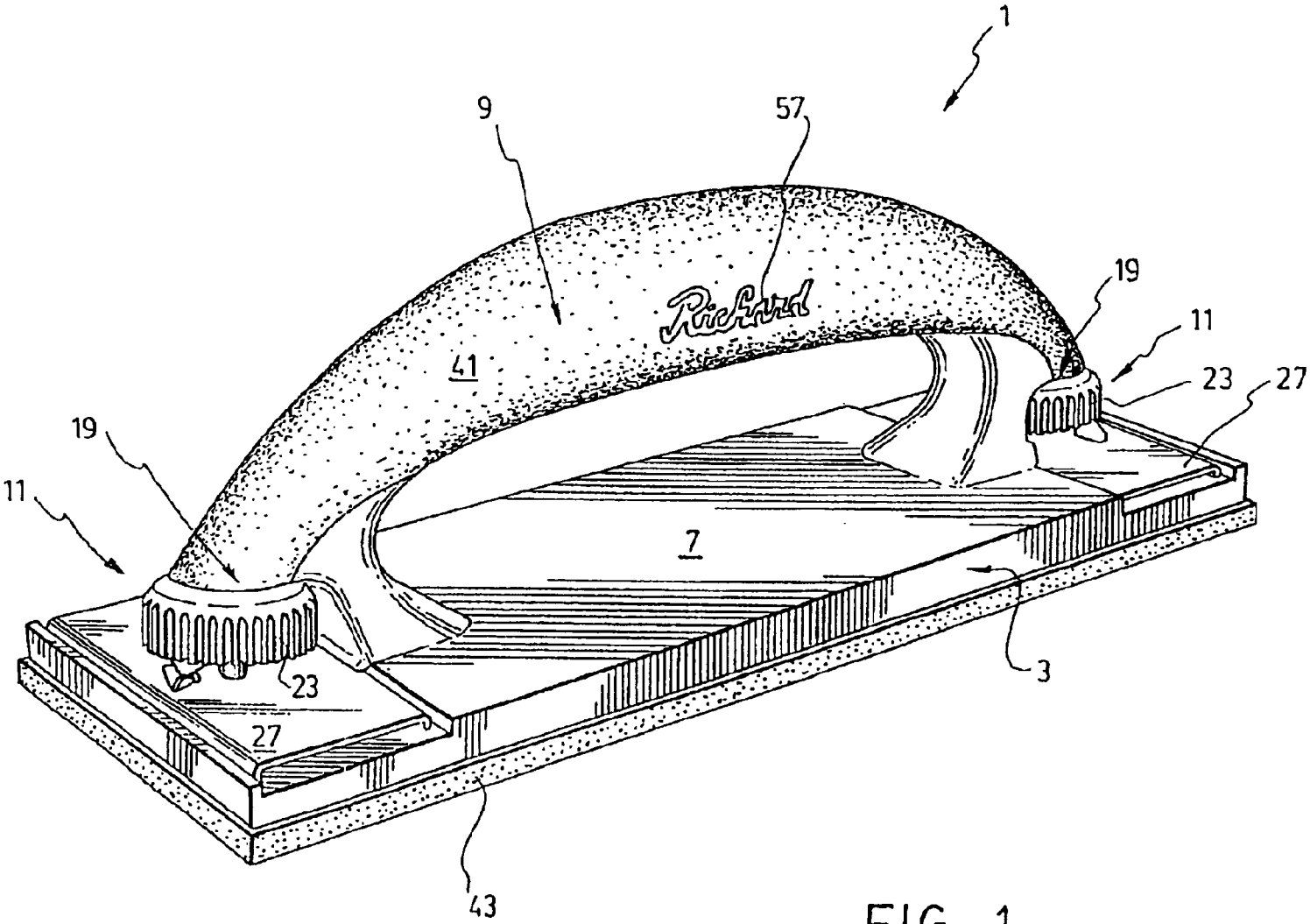
FIG. 1 a top perspective view of the sanding tool according to the preferred embodiment of the invention, the sanding tool being shown with its fastening devices in a closed position.
Figure 2:
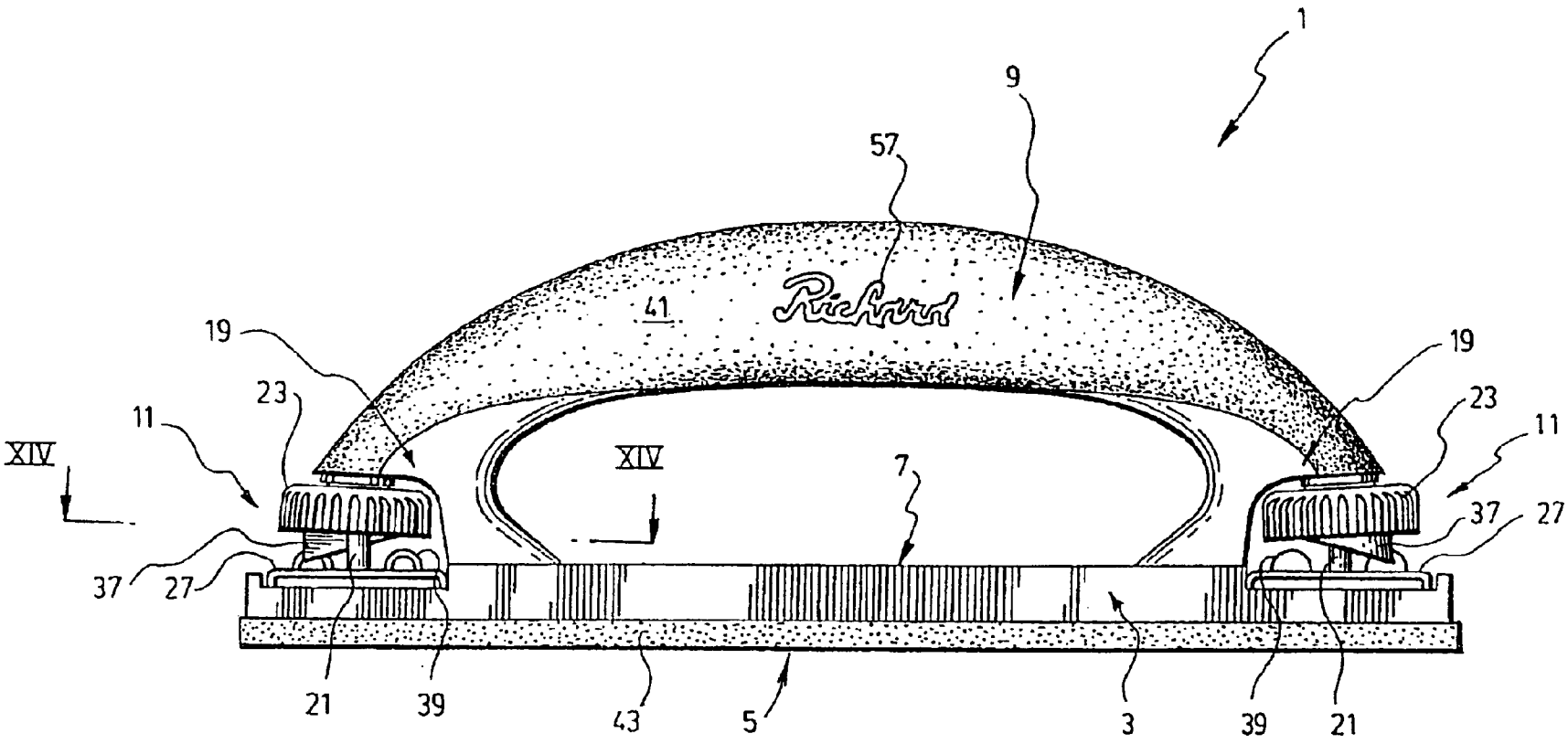
FIG. 2 is a right elevational view of the sanding tool shown in FIG. 1.
Figure 3:
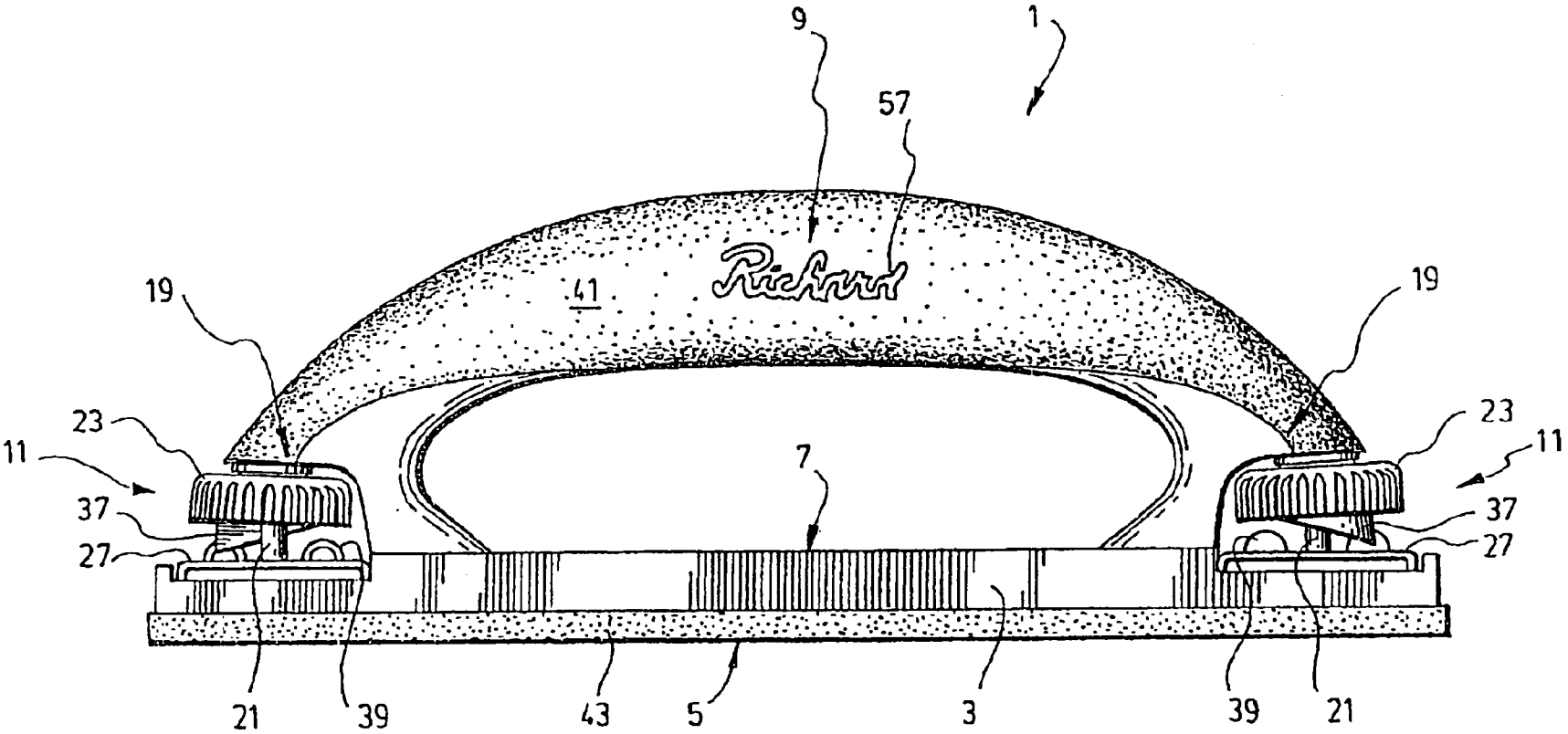
FIG. 3 is a left elevational view of the sanding tool shown in FIG. 1.
Figure 4:
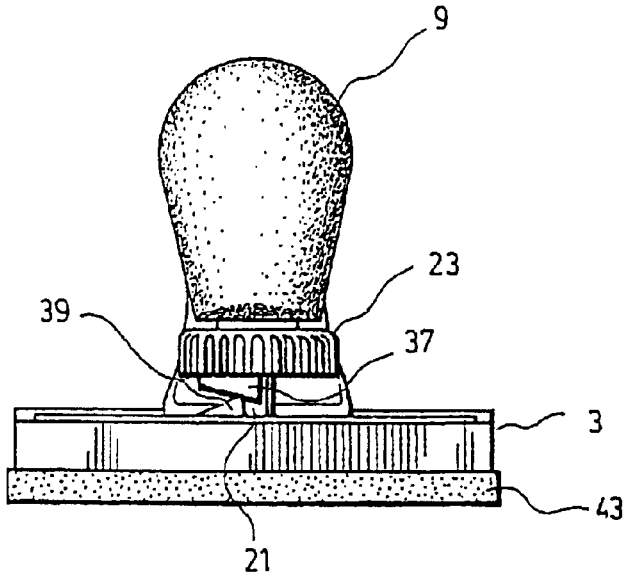
FIG. 4 is a front plan view of the sanding tool shown in FIG. 1.
Figure 5:
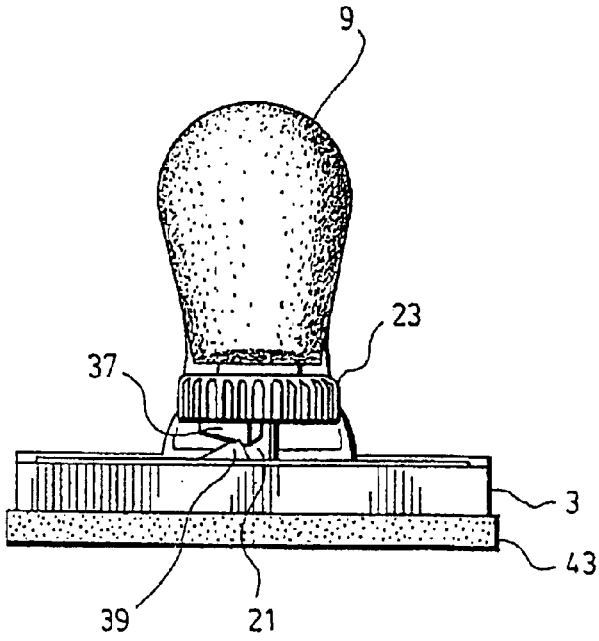
FIG. 5 is a rear plan view of the sanding tool shown in FIG. 1.
Figure 6:
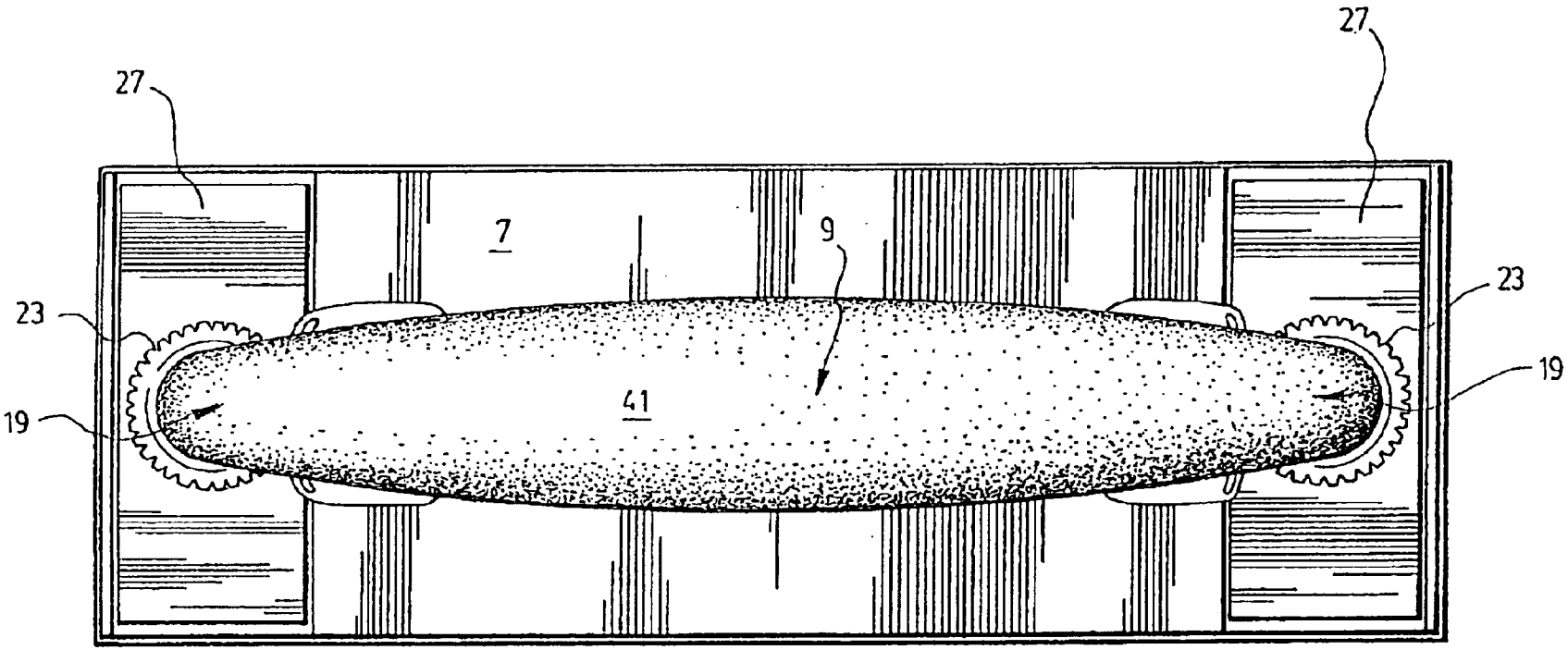
FIG. 6 is a top plan view of the sanding tool shown in FIG. 1.
Figure 7:
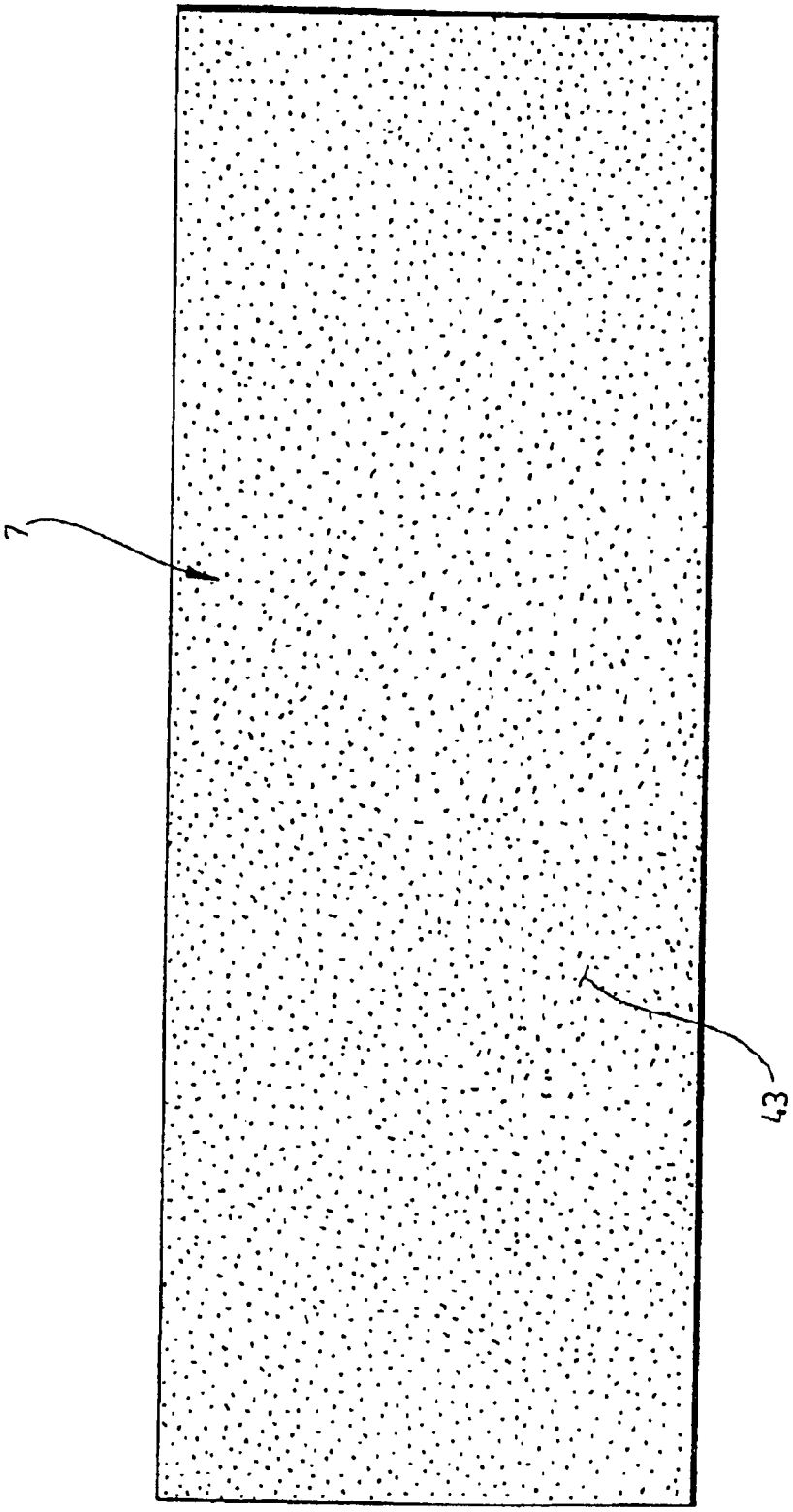
FIG. 7 is a bottom plan view of the sanding tool shown in FIG. 1.
Figure 8:
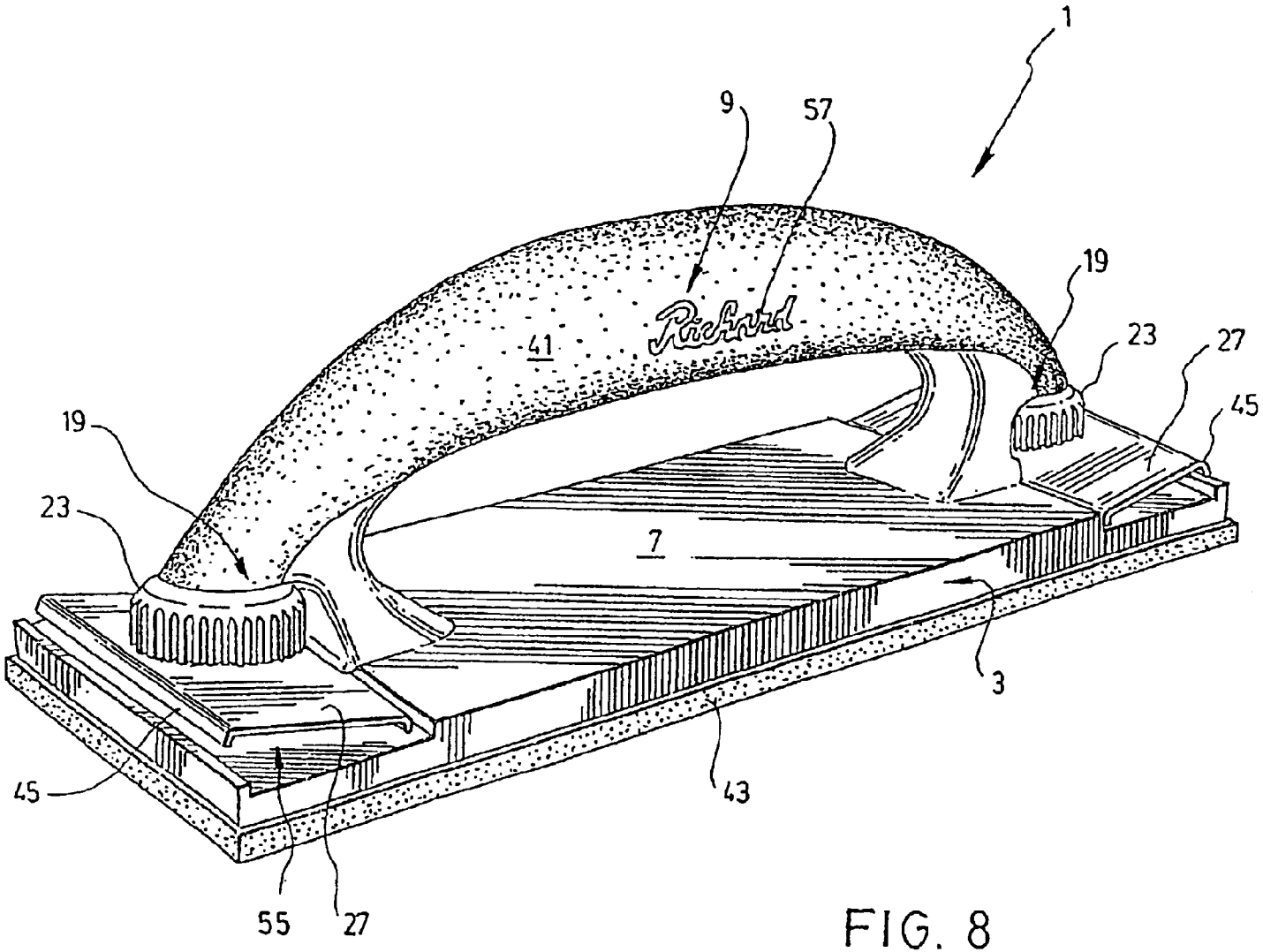
FIG. 8 is a top perspective view of the sanding tool shown in FIG. 1, the sanding tool being shown now with its fastening devices in an opened position.

Broadly described, the sanding tool 1 according to the present invention as illustrated in the accompanying drawings is a sanding tool 1 comprising a plate 3 with opposite sanding and supporting sides 5, 7, a handle 9 mounted onto the supporting side 7 of the plate 3, and at least one fastening device 11 operatively connected to the supporting side 7 of the plate 3 for fastening a sandpaper 13 onto the sanding tool 1 in such a manner that, during operation of the sanding tool 1, most of the sandpaper 13 rests against the sanding side 5 of the plate 3 and may be used to carry out sanding applications. Preferably, as shown, the sanding tool 1 comprises two of such fastening devices 11, one for each end portion of the sandpaper 13, and these fastening devices 11 are preferably mounted onto opposite sides of the handle 9, as better shown in FIGS. 1–3 and as it is customary in the field. However, it can be easily understood that the fastening devices 11 may be positioned elsewhere on the plate 3 and/or that one single fastening device 11 may suffice, depending on the particular applications of the sanding tool 1, to properly attach the sandpaper 13 onto the tool 1 and carry out satisfactory sanding applications, as apparent to a person skilled in the art. Each fastening device 11 comprises clamping means 15 and guiding means 17. The clamping means 15 are movable with respect to the supporting side 7 of the plate 3 between a first position where the clamping means 15 are away from the supporting side 7 and a second position where the clamping means 15 rest operatively against the supporting side 7. The clamping means 15 are mainly used to easily and quickly clamp a portion of the sandpaper 13 against the supporting side 7 of the plate 3 and thus, may take on various other shapes and forms than the embodiments described hereinbelow. The same applies for the guiding means 17 which are mainly used for guiding movement of the clamping means 15 along a predetermined path between the first and second positions. In operation, a portion of the sandpaper 13 is removably clamped between the supporting side 7 of the plate 3 and the clamping means 15 when the latter are in the second position.

As better shown in FIGS. 1–5, the handle 9 preferably comprises at least one flange 19 extending substantially parallel to the supporting side 7 of the plate 3 at a predetermined distance therefrom. As can be easily understood, the flange 19 need not extend perfectly parallel to the supporting side 7 of the plate 3 and may be slightly tilted with respect to said side 7, without necessarily compromising the proper operation of the tool 1, as apparent to a person skilled in the art. Preferably, the sanding tool 1 is designed to be symmetrical and thus comprises a pair of said flanges 19, i.e. preferably one flange 19 for each fastening device 11. The expression "handle" 9 according to the present invention is not to be taken in its restrictive sense, and may comprise any other suitable connecting devices (e.g. a threaded socket) for receiving suitable components enabling the sanding tool to be operated, for example, away from an operator, such as with a connecting stick for example, as apparent to a person skilled in the art. Indeed, the plate 3 according to the present invention may be deprived of a "handle" per se provided said plate 3 comprises suitable flanges 19 or "supports" for supporting the fastening devices 11. Moreover, in certain cases, such flanges 19 are not necessary, depending on the nature of the clamping means 15 being used, as will be explained hereinbelow.

Preferably, the guiding means 17 comprise a pin 21 extending perpendicularly to the flange 19 and supporting side 7 of the plate 3, the pin 21 having first and second ends mounted respectively onto the supporting side 7 of the plate 3 and each flange 19 of the handle 9, as better shown in FIGS. 2–3 and 9–13. Once again, as can also be easily understood, the pin 21 need not extend perfectly perpendicular between the flange 19 and the supporting side 7, and thus may be slightly deviated with respect to these components of the sanding tool 1, without necessarily compromising the proper operation thereof, as also apparent to a person skilled in the art. Preferably also, as better shown in FIG. 9, the pin 21 is assembled onto the sanding tool 1 by inserting the pin 21 through the plate 3 from the sanding side 5 thereof and into the corresponding flange 19 of the handle 9. It is worth mentioning however that, according to the present invention, other suitable ways of mounting the pin 21 onto the sanding tool 1 may be used, as apparent to a person skilled in the art.

Preferably also, the clamping means 15 comprise a cam 23 and securing means 25. According to the particular embodiment illustrated in the accompanying drawings, the cam 23 is preferably rotatably mounted about the pin 21 and movable between the supporting side 7 of the plate 3 and the flange 19 of the handle 9, and the securing means 25 are used for operatively securing the cam 23 against the supporting side 7, so that a portion of the sandpaper 13 is removably clamped between the cam 23 and the supporting side 7 of the plate 3 by rotating the cam 23 and securing the same against the supporting side 7 with the securing means 25. Preferably also, each fastening device 11 further comprises a clamping plate 27 mounted about the pin 21 between the cam 23 and the supporting side 7 such that the end portion of the sandpaper 13 is removably clampable between the clamping plate 27 and the supporting side 7 of the plate 3 by rotating the cam 23 and securing the same against the clamping plate 27 with the securing means 25, as can be easily understood when comparing FIGS. 10–11 and 12–13.

Each fastening device 11 preferably comprises biasing means 29 for urging the clamping plate 27 away from the supporting side 7 and the biasing means 29 preferably comprise a spring 31 coaxially mounted about the pin 21 between the clamping plate 27 and the supporting side 7, as better shown in FIGS. 9–12. Although the biasing means 29 are not essential features of the present invention, they nevertheless provide substantial advantages in that when the fastening device 11 is the opened position, the biasing means 29 urge the clamping plate 27 away from the supporting side 7 so as to facilitate the insertion of a portion of the sanding paper 13 between the clamping plate 27 and the supporting side 7. Hence, a user of the sanding tool 1 does not need to lift the clamping plate 27 from the supporting side 7 because this action is carried out by the biasing means 29. The use of such biasing means 29 enables to, namely, decrease the need for the use of two hands by an operator of the tool 1 to operate the fastening devices 11 thereof, Furthermore, it is worth mentioning that other suitable components may be used for the biasing means 29, such as a cushion pad, a metallic band, or any other suitable resilient device, as apparent to a person skilled in the art.

Figure 11:
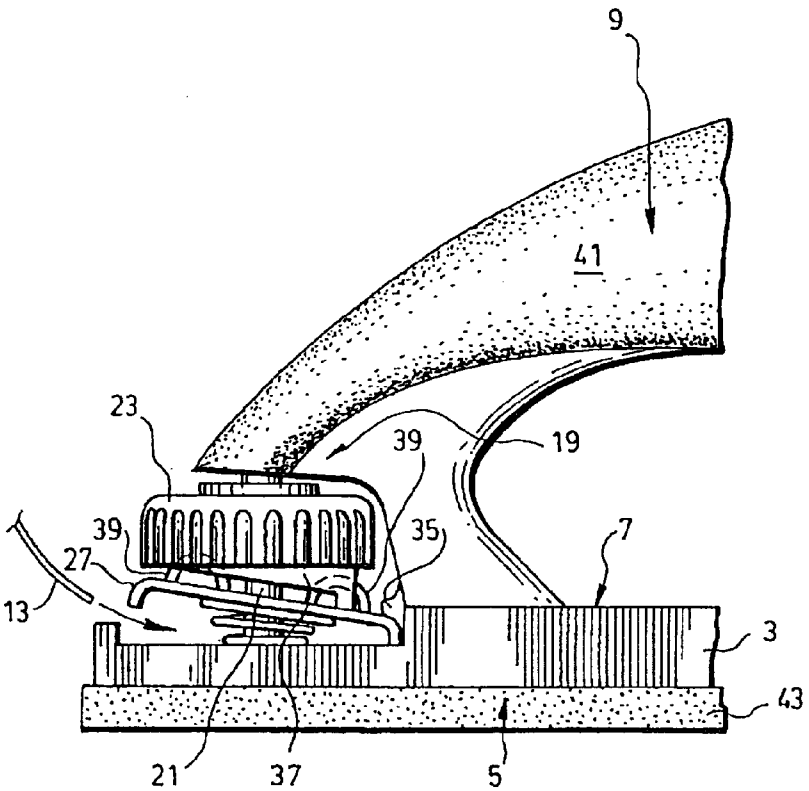
FIG. 11 is a fragmentary side elevational view of what is shown in FIG. 10, the sanding tool being shown with a portion of a sandpaper destined to be clamped thereon.
Figure 13:
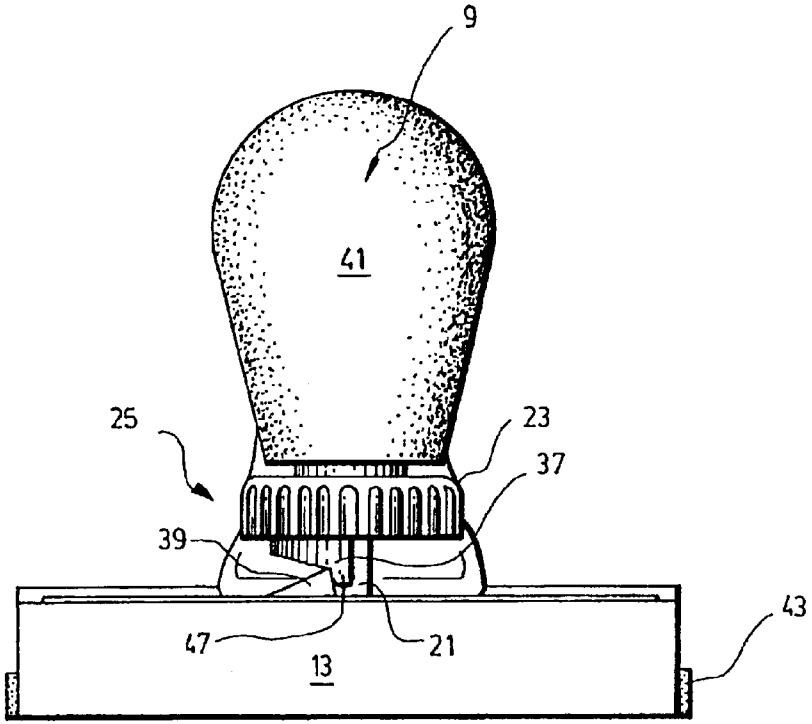
FIG. 13 is a front plan view of what is shown in FIG. 12.
Figure 12:
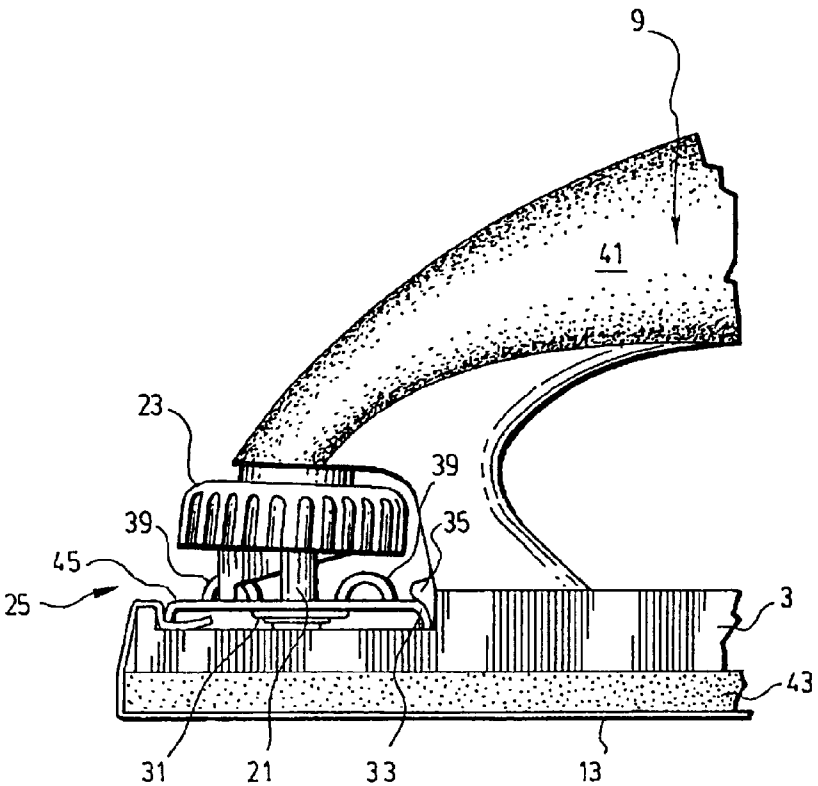
FIG. 12 is another side elevational view of what is shown in FIG. 11, the sandpaper being shown clamped onto the sanding tool.
Figure 14:
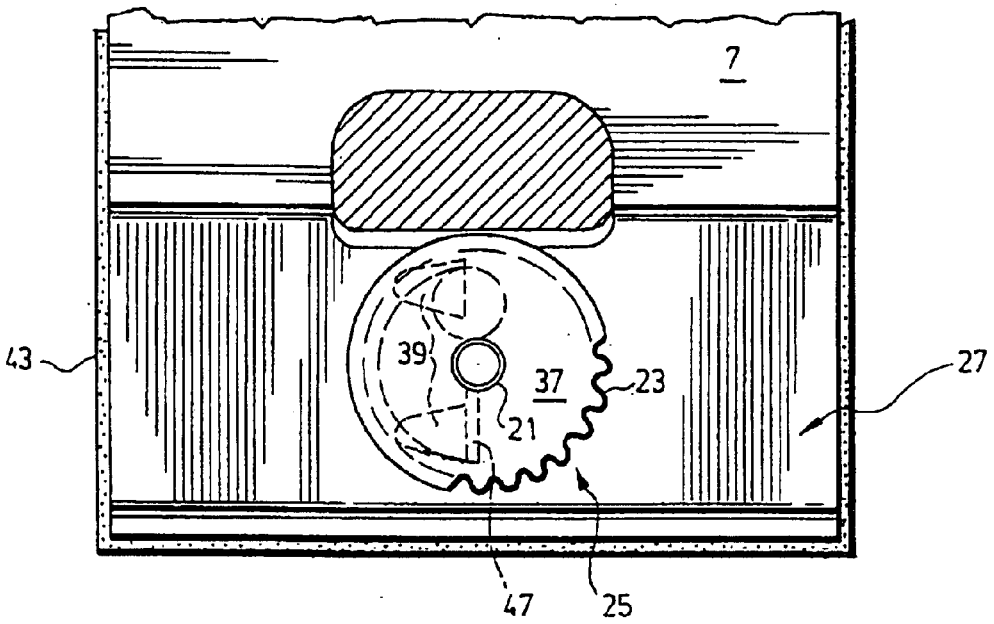
FIG. 14 is a sectional view taken along line XIV—XIV of FIG. 2.
Figure 15:
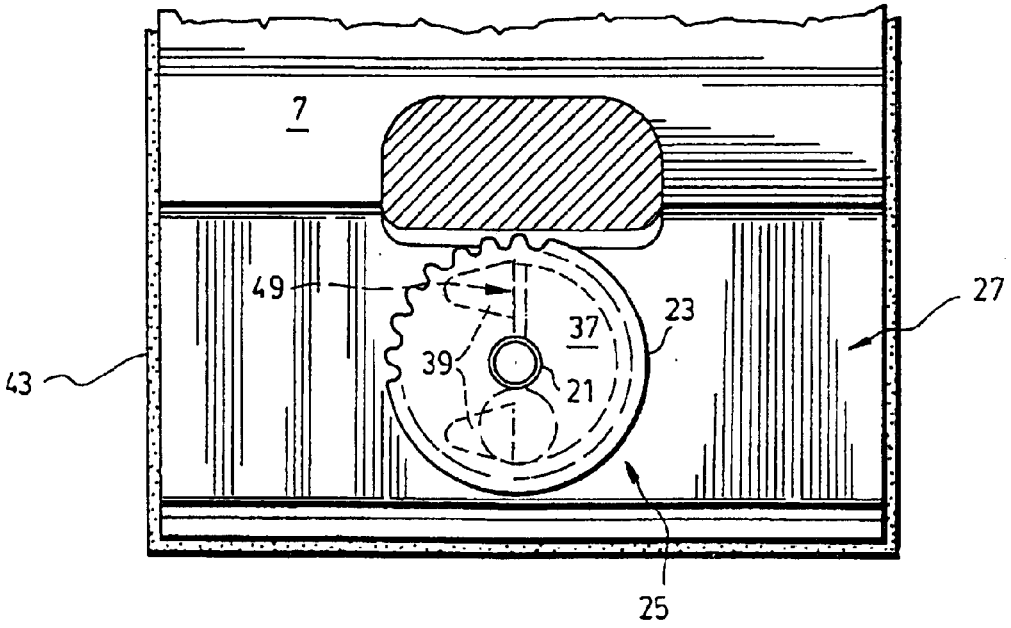
FIG. 15 is another sectional of what is shown in FIG. 14, the sanding tool being shown with the cam in an opened position.

As better shown in FIGS. 11 and 12, the clamping plate 27 preferably has a rear edge 33 in abutment with a ridge 35 provided on the supporting side 7, so that the clamping plate 27 is preferably raised in a hingedly manner when acted upon by the biasing means 29. This feature also further contributes to facilitating the insertion of a portion of the sandpaper 13 between the clamping plate 27 and the supporting side 7, as better illustrated in FIG. 11.

Figure 9:
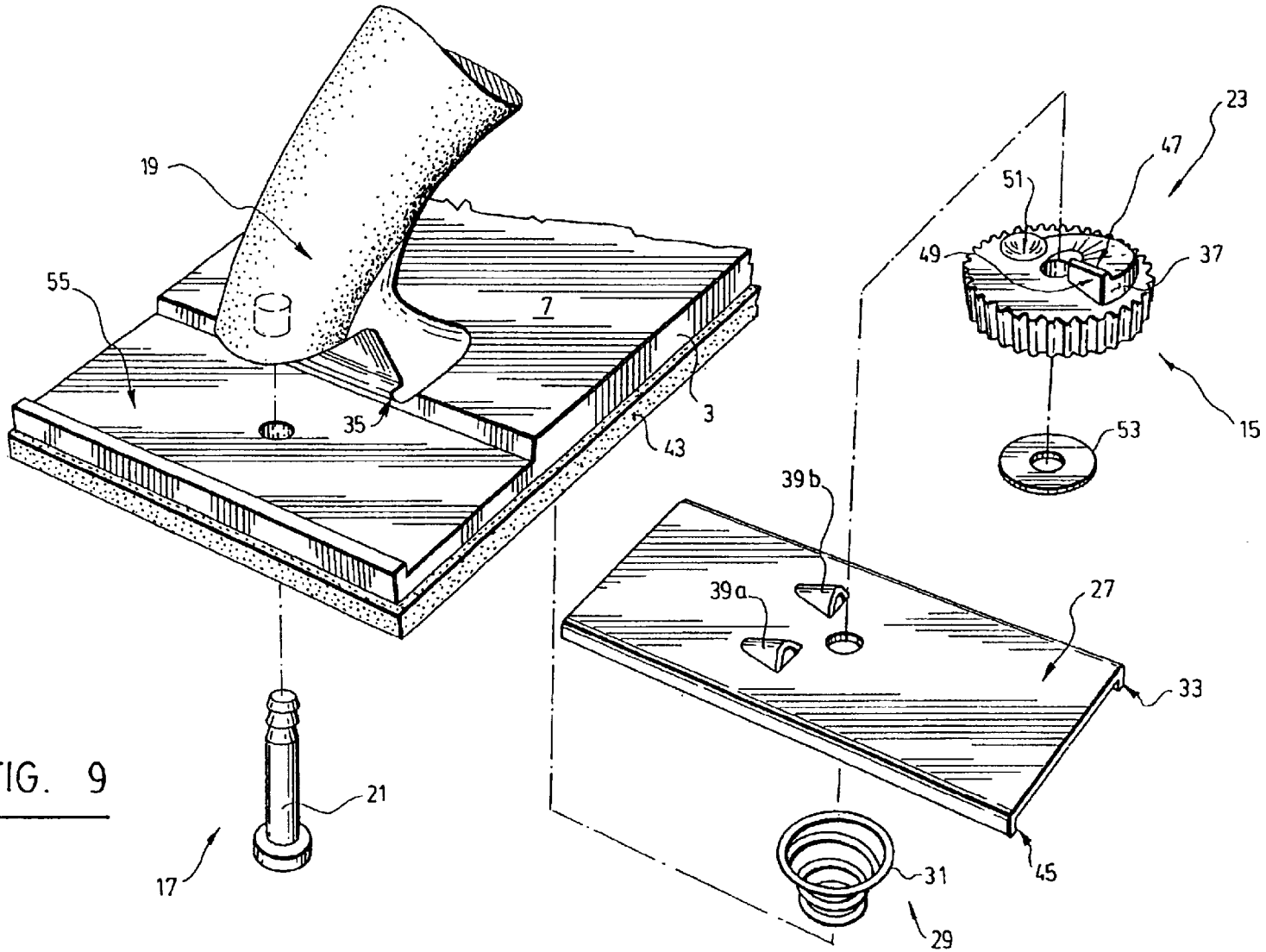
FIG. 9 is an exploded view of a fastening device of the sanding tool shown in FIG. 1.
Figure 10:
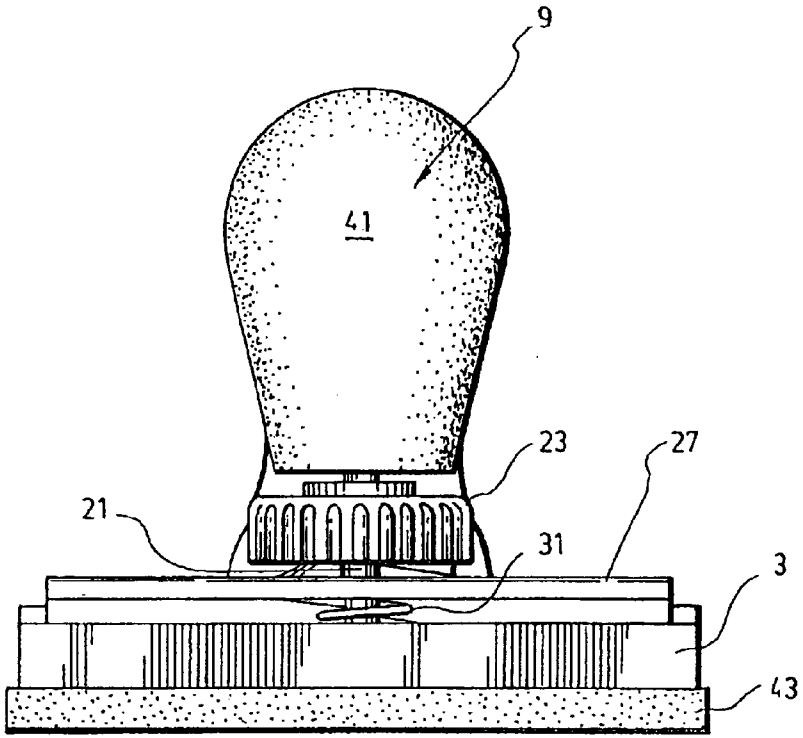
FIG. 10 is an enlarged front plan view of the sanding tool shown in FIG. 1, the sanding tool being shown with its fastening devices in an opened position.

As better shown in FIG. 9, the securing means 25 preferably comprise a protrusion 37 projecting from the cam 23 and at least one stopper 39 provided on the clamping plate 27, each stopper 39 being positioned and sized to cooperate with the protrusion 37 of the cam 23, as can be easily understood when referring to FIGS. 10–15. Indeed, according to the preferred embodiment of the invention as shown in the accompanying drawings, the clamping plate 27 is biased away from the supporting side 7 of the plate 3 by means of the spring 31, forcing a first stopper 39a of the clamping plate 27 to operatively rest against the cam 23 (see FIGS. 10 and 11). As better shown in FIG. 9, the projection 39 of the cam 23 is preferably devised to gradually increase in thickness through a given radial area of the cam 23, such that, as the cam 23 is rotated through said given radial area, a greater portion of the projection 37 is introduced between the cam 23 and the stopper 39*a*, thereby forcing the clamping plate 27 to be increasingly pushed away from the cam 23 itself and onto the supporting side 7 of the plate 3, and in turn clamp the sandpaper 13 onto the supporting side 7 of the plate 3, as can be easily understood when contrasting FIGS. 10–11 and FIGS. 12–13. As also better shown in FIG. 9, the projection 37 of the cam 23 is preferably provided with an abutment rim 47 for abutting with an upper edge of the first stopper 39*a* so as to stop rotation of the cam 23 at the end of a given travel when it is rotated along a first direction (closing direction). Preferably also, the projection 37 has an abutment plane 49 destined to abut with the second stopper 39*b* of the clamping plate 27 so as to stop rotation of the cam 23 at the end of a given travel when it is rotated along a second direction (opening direction). As also better shown in FIG. 9, the cam 23 preferably comprises a cavity 51 positioned and sized for receiving the first stopper 39*a* of the clamping plate 27 when the cam 23 is in the opened position, so as to, namely, allow the clamping plate 27 to be further raised by the spring 31 and thus allow an easier insertion of the sandpaper 13 (see FIG. 11), as well as to removably maintain the cam 23 in an opened position until it is rotated back into a closed position. The cam 23 may also be provided with a suitable washer 53 for facilitating rotation of the cam 23 against the flange 19, as apparent to a person skilled in the art.

As better shown in FIGS. 9, 11 and 12, the supporting side 7 of the plate 3 of the sanding tool 1 preferably comprises a recess 55 in which is preferably positioned the clamping plate 27 of the fastening device 11 and the clamping plate 27 preferably comprises a curved front edge 45 for better gripping and clamping the portion of the sandpaper 13 inserted between the clamping plate 27 and the supporting side 7, as better shown in FIGS. 11 and 12. It is worth mentioning that the presence of a clamping plate 27 is not absolutely necessary for the proper operation of the fastening device 11 according to the present invention and that several other modifications may be made to said fastening device 11. For example, the fastening device 11 according to the present invention may be used only with a cam 23, and securing means 25 which would include complementary threading provided along the pin 21 and along an inner portion of the cam 23 rotatably mounted about said pin 21, the cam being threadably movable along the pin 21 and towards the first portion of the supporting side 7 so as to be secured thereagainst, and thus clamp the sandpaper 13 between the cam 23 and the supporting side 7 of. the plate 3. Hence, it can be easily understood that the securing means 25 may take on several embodiments so long as they essentially fulfill the same tasks, which mainly consists in maintaining the cam 23 urged against the supporting side 7 of the plate 3 so as to be able to clamp a portion of the sandpaper 13 thereinbetween. Moreover, the expression "cam" 23 is not to be taken in its restrictive sense and is intended to include any other suitable component which would be used to press and thus clamp a portion of the sandpaper 13 to be attached onto the sanding tool 1 against the supporting side 7 of the plate 3. It is worth mentioning also that, according to the present invention, the clamping means 15 and guiding means 17 may consist of a single component, in the case where, for example, the fastening device 11 would consist of a swiveling clamping plate having one edge hingedly mounted to the supporting side 7, said clamping plate being operable between a first position where it would be swiveled away from the supporting side 7 and a second position where the clamping plate would be swiveled onto the supporting side 7 and secured thereagainst with appropriate securing means so as to clamp a portion of the sandpaper 13 between said swiveling clamping plate and the supporting side 7 of the plate 3. Hence, in this latter example, the guiding means 17 would be the "hinge means" of the swiveling clamping plate.

As better shown in FIGS. 9–13, the peripheral surface of the cam 23 is preferably knurled for facilitating manipulating of the cam 23. Preferably also, the handle 9 of the sanding tool 1 is an ergonomic handle 9 provided with an elastomer covering 41 so as to facilitate handling of the tool 1. Preferably also, the plate 3 and the handle 9 are made integral to each other, that is, constitute one single piece and are made of one single material. Preferably also, a middle portion of the handle 9 is provided with suitable projections in the shape of a logo 57, such that when the covering 41 is moulded about the handle 9, there is a visual contrast between the logo 57 and the elastomer covering 41, as better shown in FIGS. 1–3. The handle 9 and supporting plate 3 are preferably made of a substantially rigid and light material, such as a polymeric material, although other suitable materials may be used, as apparent to a person skilled in the art.

Preferably also, the cam 23, cam plate 27 and pin 21 are made of a metallic material, although suitable materials may be used depending on the particular applications for which the sanding tool 1 is intended for, as apparent to a person skilled in the art.

Preferably also, the sanding side 5 of the plate 3 is provided with a lining 43, said lining 43 providing cushioning for the sandpaper 13 resting thereon.

As may now be appreciated, the present invention is a substantial improvement over the prior art in that, by virtue of its design and components, as explained herein, the sanding tool 1 according to the present invention comprises an improved fastening device 11 which enables a sandpaper 13 to be mounted onto the sanding tool 1 in a quicker, easier, and simpler manner than what is possible with the sanding tools available in the prior art. Moreover, the present invention is also advantageous in that the fastening devices 11 of the present sanding tool 1 are deprived of projections and thus are less likely to damage a working surface being worked on if the sanding tool 1 is inadvertently flipped over against said surface. Moreover, the present invention is also an improvement over the prior art in that it provides for a more ergonomic handle 9 which facilitates the manipulating of the sanding tool 1.

Of course, numerous modifications could be made to the above-described embodiment without departing from the scope of the invention as defined in the appended claims.

What is claimed is:

1. A sanding tool comprising:

a plate with opposite sanding and supporting sides;

a handle mounted onto the supporting side of the plate, the handle comprising at least one flange extending substantially parallel to the supporting side of the plate at a predetermined distance therefrom; and at least one fastening device operatively connected to the supporting side of the plate for fastening a sandpaper onto the sanding tool in such a manner that must of the sandpaper rests against the sanding side of the plate, said at least one fastening device comprising:

clamping means movable with respect to the supporting side of the plate between a first position where the clamping means are away from the supporting side and a second position where the clamping means rest operatively against the supporting side; and guiding means for guiding movement of the clamping means along a predetermined path between the first and second positions, the guiding means comprising a pin extending perpendicularly to the flange and supporting side of the plate, said pin having first and second ends mounted respectively onto the supporting side of the plate and the at least one flange of the handle;

wherein a portion of the sandpaper is removably clamped between the supporting side of the plate and the clamping means when the latter are in the second position, the clamping means comprising a cam and securing means, the cam being rotatably mounted about the pin and movable between the supporting side of the plate and the flange of the handle, and the securing means being used for operatively securing the cam against the supporting side, whereby said portion of the sandpaper is removably clampable between the cam and the supporting side of the plate by rotating the cam and securing the same against the supporting side with the securing means.

2. A sanding tool according to claim 1, wherein the fastening device further comprises a clamping plate mounted about the pin between the cam and the supporting side, and whereby said potion of the sandpaper is removably clampable between the clamping plate and the supporting side by rotating the cam and securing the same against the clamping plate with the securing means.

3. A sanding tool according to claim 2, wherein the fastening device further comprises biasing means for urging the clamping plate away from the supporting side.

4. A sanding tool according to claim 3, wherein the biasing means comprise a spring coaxially mounted about the pin between the clamping plate and supporting side.

5. A sanding tool according to claim 4, wherein the clamping plate has an edge in abutment with a ridge provided on the supporting side.

6. A sanding tool according to claim 2, wherein the securing means comprise:

a protrusion projecting from the cam; and at least one stopper provided on the clamping plate, said at least one stopper being positioned and sized to cooperate with the protrusion on the cam.

7. A sanding tool according to claim 1, wherein a peripheral surface of the cam is knurled for facilitating manipulating of the cam.

8. A sanding tool according to claim 1, wherein the handle of the sanding tool is an ergonomic handle provided with an elastomer covering so as to facilitate handling of the tool.

9. A sanding tool according to claim 1, wherein said device includes two of said fastening devices mounted on opposite sides of the handle.

10. A sanding tool according to claim 1, wherein the sanding side of the plate is provided with a lining.

11. A sanding tool according to claim 2, wherein the cam, cam plate and pin are made out of a metallic material.

12. A sanding tool according to claim 2, wherein the cam plate comprises a curved edge.

13. A sanding tool according to claim 5, wherein:

the securing means comprise:

a protrusion projecting from the cam; and at least one stopper provided on the clamping plate, said at least one stopper being positioned and sized to cooperate with the protrusion of the cam;

a peripheral surface of the cam is knurled for facilitating manipulating of the cam;

the handle of the sanding tool is an ergonomic handle provided with an elastomer covering so as to facilitate handling of the tool;

the device includes two of said fastening devices mounted on opposite sides of the handle;

the sanding side of the plate is provided with a lining; and the cam plate comprises a curved front edge.

* * * * *